United States Patent [19]

Wilkins

[11] Patent Number: 4,804,032

[45] Date of Patent: Feb. 14, 1989

[54] METHOD OF MAKING METAL CASTINGS

[75] Inventor: Philip S. A. Wilkins, Evesham, United Kingdom

[73] Assignee: Cosworth Research & Development Limited, Worcester, United Kingdom

[21] Appl. No.: 97,970

[22] PCT Filed: Dec. 1, 1986

[86] PCT No.: PCT/GB86/00732

§ 371 Date: Jul. 27, 1987

§ 102(e) Date: Jul. 27, 1987

[87] PCT Pub. No.: WO87/03229

PCT Pub. Date: Jun. 4, 1987

[30] Foreign Application Priority Data

Nov. 29, 1985 [GB] United Kingdom ..... 8529380

[51] Int. Cl.[4] ..... B22C 9/04; B22D 18/04

[52] U.S. Cl. ..... 164/34; 164/119; 164/246; 164/365

[58] Field of Search ..... 164/34, 35, 36, 119, 164/246, 365

[56] References Cited

U.S. PATENT DOCUMENTS

| | | | |
|---|---|---|---|
| 3,222,738 | 12/1965 | Carter | 164/34 |
| 4,291,739 | 9/1981 | Baur | 164/34 X |
| 4,693,292 | 9/1987 | Campbell | 164/34 |

FOREIGN PATENT DOCUMENTS

| | | | |
|---|---|---|---|
| 0152754 | 8/1985 | European Pat. Off. . | |
| 1332924 | 3/1964 | France . | |
| 2153274A | 8/1985 | United Kingdom | 164/246 |

OTHER PUBLICATIONS

Dieter, H. B. et al. "Sand Without Binder For Making Full Mold Castings" In *Modern Casting*, vol. 51, No. 6, June 1967, pp. 133–146, 164–34.

*Primary Examiner*—M. Jordan
*Assistant Examiner*—J. Reed Batten, Jr.
*Attorney, Agent, or Firm*—Marhsall, O'Toole, Gernstein, Murray & Bicknell

[57] ABSTRACT

Method of and apparatus for making metal castings using a polystyrene pattern 10 embedded in unbonded sand 20 which is consolidated to form a mould M in which is defined a mould cavity C. Molten metal is fed into the cavity C and permitted to solidify to form a casting 11. The metal is aluminum or an aluminum alloy and at least part of the mould is formed of sand which comprises at least 50% zircon sand, or other particulate material suitable for making a mould and having a bulk density lying in the range 2–3 grams/cc. The mould M may have a moulding feature 9 having upper and lower surfaces for contact with the metal and which projects inwardly of the mould cavity C from the main wall thereof and the length of any one section of the molding feature 9 being at least twice the thickness of the thinnest part thereof by which the section is connected to the main wall of the mould cavity.

17 Claims, 3 Drawing Sheets

METHOD OF MAKING METAL CASTINGS

This invention relates to a method of making metal castings using the full mould process, namely providing an in situ destroyable pattern of, for example, expanded polystyrene, embedding the pattern in unbonded sand, consolidating the sand to form a mould in which is defined a mould cavity, feeding molten metal into the cavity, permitting the metal to solidify within the cavity to form a casting, interrupting the feed of metal to the cavity and removing the casting from the cavity. The pattern may be destroyed in situ either by the metal as it is fed into the cavity, or by the application of heat prior to introduction of the metal into the cavity.

Problems of lack of accuracy and poor surface finish have been encountered when using the full mould process to produce high quality castings of an aluminium or an aluminium alloy.

An object of the present invention is to overcome this problem.

In accordance with the present invention I provide a method of making metal castings comprising the steps of providing an in situ destroyable pattern, then embedding the pattern in unbonded sand and consolidating the sand to form a mould in which is defined a mould cavity, then feeding molten metal into the cavity and permitting the metal to solidify within the cavity to form a casting and interrupting the feed of metal to the cavity and removing the casting from the cavity, wherein the metal is aluminum or an aluminum alloy and at least part of the mould being formed of said which comprises at least 50% sand as herein defined, by weight of sand.

Said part may comprise at least one moulding feature, made of unbonded sand, as hereindefined.

Said part may comprise unbonded sand and comprise the whole or substantially the whole of the mould.

Said mould cavity may comprise at least one preformed moulding feature which is included in said pattern.

Said part may comprise at least one preformed moulding feature which is included in said pattern.

Said preformed moulding feature may be as hereindefined.

The whole of the mould, except the or each preformed moulding feature may comprise unbonded sand which comprises at least 50% sand, as hereindefined, by weight.

The invention also provides, according to another aspect, a method of making metal castings comprising the steps of providing an in situ destroyable pattern, then embedding the pattern in unbonded sand and consolidating the sand to form a mould in which is defined a mould cavity, then feeding molten metal into the cavity and permitting the metal to solidify within the cavity to form a casting and interrupting the feed of metal to the cavity and removing the casting from the cavity, wherein the mould cavity comprises a moulding feature as hereindefined, made of at least 50% sand, as hereindefined, by weight of sand.

The moulding feature may be formed of unbonded sand, or the moulding feature may be preformed of sand bonded with a bonding agent.

In either aspect of the invention, the unbonded sand may comprise wholly or substantially wholly zircon sand, except for usual impurities, whilst the bonded sand may comprise wholly or substantially wholly zircon sand and bonding agent except for usual impurities.

By virtue of using at least 50% zircon sand and preferably wholly, or substantially wholly, zircon sand, I have found an unexpected improvement in the quality of the casting produced compared with castings produced using the full mould process to cast such metals, particularly where a moulding feature as hereinbefore is provided in the mould cavity, when the mould is made of other sand, such as silica sand.

Analysis of the system in the light of this unexpected result leads to the belief that the improvement is due to the density of the sand being substantially the same as the density of the molten metal being cast. It is believed that this minimises the hydrostatic forces acting on the moulding feature thereby greatly improving mould stability during casting and hence greatly improving the final accuracy of the casting.

Because the mould when comprising a moulding feature, as hereindefined, has portions which are relatively thin and extend in cantilever or in beam a significant distance from the remainder of the mould cavity, then these portions are subjected to minimised hydrostatic forces, thereby greatly improving the mould stability. The breaking off of such portions, which has sometimes been observed when the mould has been made of other sand, is avoided.

Analysis of the system leads me to believe that the quality of the casting is further improved because zircon sand produces a more compacted or consolidated mould, for given compaction techniques, than other sands. Indeed, the improvement in compaction is such that less sand head is required for an equivalent mould strength to resist the hydraulic filling loads of the molten metal than is necessary with other sands. This is due to the density of zircon being approximately twice that of conventional sands.

The method may be performed by embedding the pattern directly in the sand without application of a refractory coating to the pattern.

I have found that when using zircon said it is not necessary to apply a refractory wash to the pattern. This is a significant advantage because the usually applied refractory wash, which it is necessary to apply when using other sand such as silica sand, is often very difficult to apply, especially when used in cored areas, with which the present invention is specifically concerned, and is also difficult to remove from the resulting casting.

Moreover, the presence of the conventional refractor coating inhibits easy removal of the products resulting from the destrution, e.g. by combustion or vapourisation, of the pattern causing difficulties when attempting to fill a mould quickly or when filling thin sections of the mould.

Alternatively, a non-refractory coating may be applied to the pattern prior to embedding in the sand. For example varnish, paint, starch, to improve the surface finish of the resulting casting. Alternatively the non-refractory coating may be an exothermic coating applied to aid filling of thin sections of the mould.

I have found that zircon sand has better mould filling capability and compaction thereof is easier than other sands. It is believed that this is because zircon sand has an essentially spherical grain form which flows more easily than other sand grains.

Zircon sand can be readily cleaned and reclaimed, if necessary, by economical thermal reclamation due to its refractory properties with minimal loss due to degradation and greatly reduced dust problems.

The final accuracy of the casting is also though to be contributed to by virtue of the low and predictable coefficient of thermal expansion of zircon sand. This is believed to reduce relative movement between the moulding feature and the main wall of the mould to negligible amounts, so giving rise to the exceptional accuracy and reproducability which has been achieved by the present invention. It also greatly reduces scuffing between the moulding feature and the cast metal during solidification, thereby giving a greatly improved surface finish compared with that attained with other sands.

It has also been noted that the as cast mechanical properties of the casting produced according to the invention are improved compared with those attained with other sands and this is due to the heat capacity of zircon sand which gives faster casting cooling rates, indeed rates which are similar to those attained with conventional metal dies.

Provision of a preformed moulding feature retains all the advantages of conventional casting using an in situ destroyable pattern such as absence of flash, economy and the like but provides the following additional advantages. Hitherto, when using such a pattern for castings with relatively complicated internal cavities, the pattern has been made by securing together, by means of an adhesive, a plurality of relatively thin slices of pattern each of which is formed with the desired portion of cavity. Typically the complete pattern has comprised five slices. It has been necessary to age and condition these slices individually and then accurately to assemble and glue them together without using excess glue or too little. It has proved to be a considerable problem in practice to achieve this because the individual slices can change shape on aging or conditioning and it can be difficult or impossible to assemble them sufficiently accurately. In addition, unless the precisely correct amount of adhesive is applied, if excess is applied then it is exuded from the joint lines and is either necessary to remove the glue or the glue forms defects in the casting and it is generally not possible to remove any such excess glue from the internal cavities. If, on the other hand, to avoid this the adhesive applied is minimised, there is a danger that insufficient adhesive would be applied thus permitting separation of the slices.

Moreover, extensive problems have been encountered in achieving filling of the cavities with the unbonded sand when the pattern is embedded therein.

The preformed moulding feature or features, such as cores, are accurately dimensioned and since the accuracy of the casting is determined by the accuracy of the internal cavity, then the accuracy of the casting is dimensionally controlled by the moulding feature or features, in this example cores. In addition the problems arising from excess glue are avoided both internally and externally and of course there are no problems in achieving filling of the cavities with sand.

Moreover, the in situ destroyable pattern can be used almost immediately after blowing since it does not need to be aged or conditioned because the accuracy of the casting is controlled by the preformed moulding feature or features.

Other features of the invention will now be described.

The pattern may be destroyed in situ by the heat of the metal as it is fed into the mould cavity.

Alternatively the pattern may be destroyed in situ prior to feeding the metal into the mould cavity.

The pattern may comprise a casting part to provide a casting portion of the cavity and an ingate part to provide a casting ingate portion of the cavity.

The pattern may also be provided with a runner system part to provide a runner system portion of the cavity and a runner ingate part to provide a runner ingate portion of the cavity.

The metal may be fed from source into the mould through an orifice in a container for the mould.

The casting ingate part of the pattern may be disposed in casting relationship with the orifice and then the sand may be introduced around the casting part and casting ingate part to embed the pattern within the sand.

The runner ingate part of the pattern may be disposed in casting relationship with the orifice and then the sand may be introduced around the casting part and runner system and runner ingate parts to embed the pattern within the sand.

The pattern may be supported within a container by means of a feed member which is mounted within the container, and sand may be introduced into the container to embed the pattern therein. Thereafter, metal may be fed through a passage provided by the feed member into the mould cavity.

The pattern may be disposed within a peripheral wall extending upwardly from a mould base to provide a mould box or container into which the sand is introduced to embed the pattern therein.

The pattern may be coated with a refractory coating which may improve surface finish.

Preferably, the pattern is uncoated or may be coated with a non-refractory coating to improve surface finish, for example varnish, paint or starch.

The sand in which the pattern is embedded may be consolidated by vibration or the application of a vacuum, or by other means, or by a combination of such means.

A pressure below atmospheric pressure may be applied to the mould during casting to assit consolidation and/or removal of vapour or other decomposition products of the pattern.

The metal may be fed downwardly under the force of gravity from a source of molten metal into the mould cavity.

Alternatively, and preferably, the metal may be fed generally upwardly against the force of gravity from a source of molten metal into the mould cavity.

The source of molten metal preferably comprises a reservoir of molten metal which is at a level which is below the level of the cavity.

The metal may be fed into the mould cavity through a passage having an end surrounded by the molten metal in the source, an opposite end which is connected to the mould cavity and an intermediate part which extends through the free upper surface of the molten metal in the source.

A pump may be provided to pump metal upwardly from the reservoir into the cavity through the passage.

The metal may be pumped into the cavity at the bottom thereof.

The metal to be cast may be supplied to the reservoir by feeding metal in solid state therein to, and melting the metal in the reservoir.

The reservoir may have a feed region whereat said metal is fed into the reservoir in solid state, and a casting region from which metal, in liquid state, is drawn by said pump.

The reservoir may have a heating region, between the feed region and the casting region in which heat is applied to the metal in the reservoir.

Alternatively the metal to be cast may be applied to the reservoir in molten state from a source of molten metal separate from the reservoir.

The metal may be supplied to the reservoir by means of a ladle.

The metal may be supplied to the reservoir by means of a launder.

The metal may be supplied to the reservoir from a melting furnace separate from the reservoir.

The metal may be pumped by an electro-magnetic pump or by a fluid pressure pump.

Alternatively the metal may be pumped by providing the reservoir within a sealed housing and pressurising the interior of the housing to force metal upwardly through a riser tube extending from below the level of metal in the reservoir through the housing.

After the metal has solidified, the level of metal in the riser tube may be lowered below the level of the entry to the mould and thereafter the mould and casting are removed from casting relationship with the source of metal, together with the mould base.

The casting may be removed from the mould by tipping out the sand or by fluidising the sand or by any other desired means.

After removal of the casting from the mould, the ingate and any other running system and feeding system, if present, may be removed from the casting.

The mould cavity may be filled by a flow of metal generally upwardly against the force of gravity throughout the mould cavity.

The mould cavity may be filled without any substantial flow of the metal downwardly under the influence of gravity within the mould cavity.

The metal may be fed into the mould cavity by a low pressure delivery system, which causes a differential pressure to exist between the pressure in the mould cavity and the pressure in the source of molten metal.

Said differential pressure may be in the range of 0.1 to 1.0 atmospheres and preferably 0.20 to 0.70 atmospheres.

The mould cavity may comprise at least one casting portion, in which a final casting is produced, and metal is fed to the casting portion at a single location and the casting portion is designed so that no part thereof is fed from another part of the casting portion along a path having any substantial flow downwardly under the influence of gravity.

The mould cavity may comprise at least one casting portion, in which a final casting is produced, and metal is fed into the casting portion at a plurality of locations so that the casting portion is filled by generally upward flow of metal from a plurality of locations against the force of gravity without any substantial flow of metal downwardly under the influence of gravity.

The mould cavity may include a casting ingate portion which communicates directly with the casting portion.

The casting ingate portion of the cavity may communicate with a runner system portion of the cavity which is provided with a runner ingate portion of the cavity which communicates with the source of metal.

The casting ingate portion may communicate with a source of metal without any runner system.

The ingate may be placed in casting relationship with the orifice by inserting a portion of the ingate part of the pattern into close fitting engagement within the orifice.

The orifice may be lined with, or integrally formed in, thermally insulated refractory material capable of withstanding the liquid metal to be cast.

The orifice may be reused for a plurality of castings.

Alternatively the orifice may be disposed of after each casting operation.

The orifice may be formed as an insert in the mould base.

The orifice may be placed in casting relationship with the source of metal and a feed is effected by the use of a ceramic fibre gasket between a riser tube extending between the source of metal and the member in which the orifice is formed.

Said feeding of molten metal generally upwardly against the force of gravity from the source of molten metal into the mould cavity may be performed without any substantial flow of metal downwardly under the influence of gravity between the source and the entry into the cavity.

The filling defects which are encountered when metal is allowed to fall under gravity to fill a mould cavity arise because of the action of the liquid metal whilst it falls downwards under gravity. The uncontrolled tumbling, splashing, surging etc., introduces and entraps oxides, gases and decomposition products from the pattern and mould materials into the metal. Even when the flow is more gentle, cool streams of metal develop a carbon deposit from decomposing styrene vapour, which prevents tow such streams from effectively merging in parts of the casting.

By feeding metal upwardly against the influence of gravity I have found that the above mentioned problem is overcome or reduced because the gentle rise of the substantially horizontal metal surface keeps the metal separate from and unmixed with the decomposable pattern and its decomposition products since decomposition of the pattern occurs progressively ahead of the advancing metal surface.

By an "in situ destroyable pattern" I mean a pattern which, when in a solid state, is sufficiently strong to enable the sand to be formed therearound and which can be destroyed in situ so as to leave a mould cavity. For example, the pattern may be destroyed in situ by being at least substantially completely transformed to the gaseous state, whilst within the sand and the sand permitting the transformation products to leave the cavity. The pattern may be subjected to heat to cause it to vaporise and/or burn and/or undergo some other chemical reaction. One example of a suitable destroyable pattern is a pattern made of expanded polystryene which is decomposed by combustion substantially to the gaseous state on heating. Such a pattern is commonly known as an evaporative pattern. Of course some of the decompositon products may be small solid particles such as soot but these can leave the mould cavity together with the gaseous products of combustion, for example by passing through the pores between the particles of the particulate material. Although it is preferred that the pattern is destroyed in situ by utilising the heat of the molten metal as it is cast into the mould, if desired, the pattern may be pre-destroyed in situ, for example, by applying heat to the pattern prior to casting.

By a "moulding feature as hereindefined" I mean a moulding feature which has upper and lower surfaces for contact with the metal and which projects inwardly of the mould cavity from a main wall thereof and has a configuration such that, if the mould were made of 100% silica sand, except for usual impurities, and LM25 aliminum alloy were the metal cast, a part of the casting resulting from the moulding feature is displaced by at least 5% from its designed position relative to the nearest part of the casting defined by the main wall of the cavity. For example, the length of any one section of a moulding feature may be at least twice the thickness of the thinnest part thereof by which the section is connected to the main wall of the mould cavity.

By "sand as hereindefined" I mean zircon sand, or other particulate material suitable for making a mould and having a bulk density lying in the range 2–3 gm/cc.

According to another aspect I provide a mould for making metal castings comprising consolidated unbonded sand in which is embedded an in situ destroyable pattern to define a mould cavity, there being provided in the mould cavity a moulding feature as hereindefined and comprising at least 50% sand as hereindefined, by weight of sand and, optionally, any other feature of the mould disclosed or claimed herein.

Three embodiments of the invention will now be described by way of example, with reference to the accompanying drawings, wherein.

Figure 1:
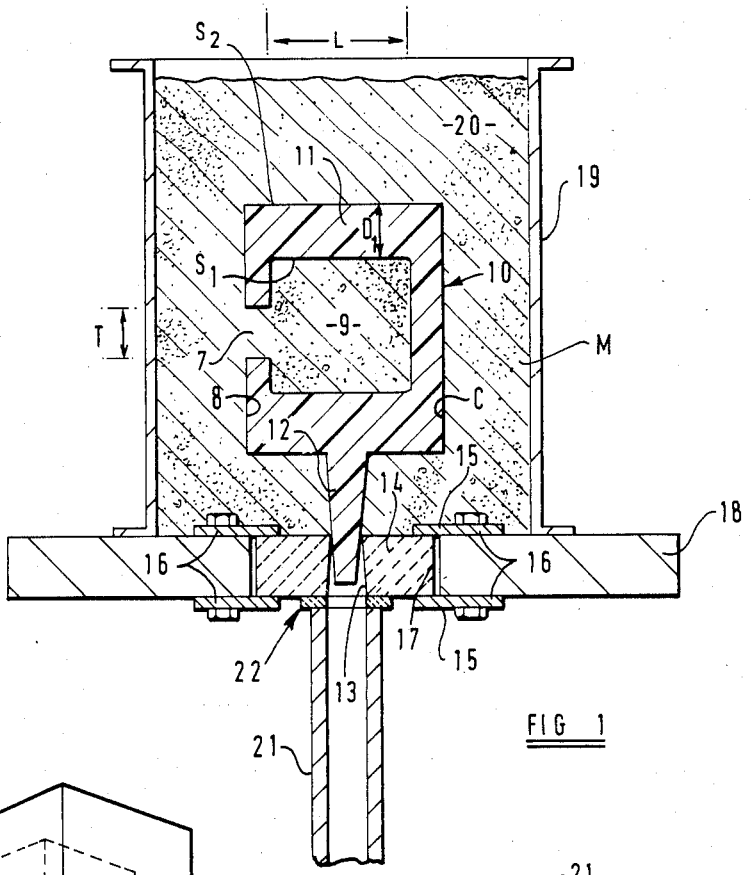
FIG. 1 is a diagrammatic cross-sectional view through part of an apparatus for performing the method embodying the present invention.

Referring to the drawings, a pattern made of expanded polystyrene is indicated at 10 and comprises two parts namely a casting part 11 of a desired shape of the final casting to be produced, and a casting ingate part 12. The pattern 10 is made in conventional manner by introducing polystyrene granules into a moulding machine where they are injected into a die of the desired configuration. Steam is then injected which causes the granules to expand and fuse together. The resultant expanded polystyrene pattern is then water cooled and ejected from the die.

Although in the example illustrated the pattern is a one-piece moulding with the casting parts 11 and 12 integral with each other, depending upon the shape of the final casting and ingate or ingate and runner system, the pattern may be moulded in two or more separate parts bonded together by a suitable adhesive or other means.

The pattern is then stored so that the normal pattern shrinkage occurs prior to use of the pattern. Of course, the die in which the pattern is made of correspondingly larger size to allow for the shrinkage both of the pattern and of the fina casting.

The pattern 10 is then positioned so that the ingate part 12 is in close fitting engagement with a cylindrical orifice 13 formed in an insert 14 made of suitable insulating refractory material such as a lightweight refractory cement, removably mounted by plates 15 secured in position by bolts 16 in an aperture 17 of a mould base board 18. An open bottomed and topped wall member is then positioned on top of the mould base 18 so that the pattern 10 is supported within a container 19 by means of the ingate part 12, which is mounted within the container by said engagement with the orifice 13. Then sand 20 is poured into the container 19 around the pattern 10 so as to embed the pattern 10 in the sand 20 and form a mould M in which is defined a mould cavity C.

The casting part 11 is shaped so as to provide the mould cavity C with a moulding feature 9 which projects inwardly of the cavity C from a main wall 8 thereof and has a length L which is in the present example three times the minimum thickness T of a part 7 of the feature 9 by which the feature 9 is connected to the main wall 8.

In the present example, the sand comprises 100% zircon sand and is without any binder or any other component except for usual impurities. If desired the sand may comprise up to 50% of sand other than zircon sand such as silica sand and/or olivine sand or any other suitable particulate material having a bulk density in the range 2–3 gm/cc. But it is preferred that the sand comprises wholly, or substantially wholly, zircon sand.

The zircon sand has a particulate grain size lying in the range 50μm to 500μm. An average grain size of 150μm is common but as low as 75μm is experienced.

In the present example, the sand is consolidated around the pattern 10 by vibrating the assembly of mould base 18, container 19 etc., but it may be consolidated by any other suitable means such as the application of suction to the interior of the mould material, or by other means or by a combination thereof and may be consolidated whilst the sand is poured into the container 19 as well as, or instead of, thereafter.

The mould base 18 carrying the moulding material 20 and pattern 10 therein is then positioned in casting relationship with a conventional low pressure casting machine Ma so that a riser tube 21 of the machine is placed in sealing engagement with the insert 14 with a ceramic fibre gasket 22 therebetween to provide a liquid-tight seal.

The low pressure die casting machine ma comprises a furnace 23 having electrical heating elements 24 containing a sealed reservoir 25, to which molten metal is fed from a separate melting furnace by means of, for example, a ladle. The riser tube 21 provides a passage which has a lower end immersed in the molten metal in the furnace, an upper end for connection to the mould feature by sealing engagement with the insert 14 and an intermediate portion which extend through the free, upper, surface of the molten metal. If desired the molten metal may be fed by other means such as a launder. After filling with molten metal the reservoir 25 is sealed and the machine Ma is then operated by pressurising the reservoir 25 in conventional manner by applying gas, e.g. air or nitrogen, under pressure, e.g. 0.2 to 0.7 atmospheres, so as to force metal up the riser tube 21 to cast molten metal into the mould cavity C through a feed member provided by the casting ingate part 12.

If desired, metal may be fed from a holding furnace which need not be sealed from the atmosphere by using a pump separate from the reservoir such as an electromagnetic pump of a fluid pressure pump.

In the present example, the metal is an LM25 aluminum alloy, but may be any other aluminum alloy or pure aluminum. The molten metal is fed by the casting machine through the riser tube 21 and into the orifice in the insert 14 where the heat of the metal causes progressive decomposition of the ingate part 12 and casting part 11 so that the pattern 10 is destroyed by being decomposed into gas and/or small solid or liquid particles which escape from the resultant cavity through the pores between the particles of sand 20. Thus, the molten metal occupies the mould cavity C in the sand 20 which was previously occupied by the pattern 10.

If desired, a partial vacuum may be applied to the mould during at least the initial stages of feeding metal into the mould to assist with consolidation and/or removal of vapour or other decomposition products of the pattern.

After the mould cavity C has been filled with liquid metal, the metal is allowed to solidify, or at least solidify to the extent so as to be self-supporting. Pressure is then released or partially released to allow the metal to fall back or partially fall back from the level of the ingage down the riser tube into the reservoir, and then the mould and the casting therein are removed out of casting relationship with the casting machine Ma together with the mould base 18 and thereafter the casting is removed from the moulding material, either by tipping the sand out of contact with the casting or by fluidising the sand to permit it to flow or by other means.

The ingate is then removed from the casting.

Although in the present example, the orifice 13 is formed in a removable insert 14, if desired, the orifice may be formed in other material than insulating refractory material but be lined with insulating refractory material. For example the orifice may be defined in a sleeve of the insulating refractory material provided in an opening in an aluminum plate mounted on, or which itself forms the mould base 18. The insert 14 may be used for a considerable number of casts or replaced after each case or a small number of casts depending upon the metal being cast and the material of which the orifice is made.

In the present example, the casting ingate is placed directly in casting relationship with the riser tube. If desired, however, in any particular casting where feeding is required to a plurality of locations to ensure that the casting is fed by movement of metal upwardly against the influence of gravity, a plurality of casting ingates may be provided interconnected to a runner system along with which the molten metal passes against the force of gravity without any substantial flow downwardly under the influence of gravity, and the runner system itself having a runner ingate which is placed directly in casting relationship with the riser tube and serves as a feed member to support the pattern within the container.

Alternatively, a plurality of separate castings may be made at the same time by feeding molten metal thereto by a similar feeder system extending from the feeder ingate to a casting ingate of the cavity for each casting. Alternatively, more than one riser tube may be provided to feed the metal to feeder ingates corresponding to the number of riser tubes. Each feeder ingage may comprise also a casting ingate or each feeder ingate may be connected to a plurality of casting ingates by a runner system.

Figure 3:
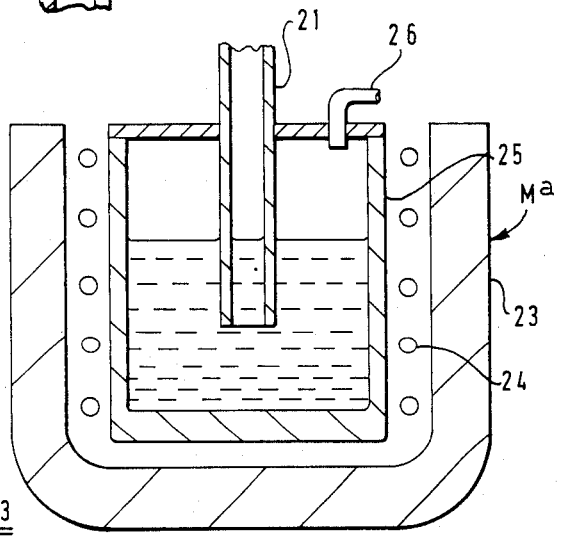
FIG. 3 is a diagrammatic cross-section to a reduced scale through a low pressure casting machine for use with the apparatus shown in FIG. 1.

In the second embodiment of the invention the metal, method, pattern and apparatus are as described in connection with the first embodiment, except that, instead of feeding molten metal into the moulds using the machine shown in FIG. 3, there is used the apparatus shown in FIG. 4 and a different shape of pattern is shown.

Figure 4:
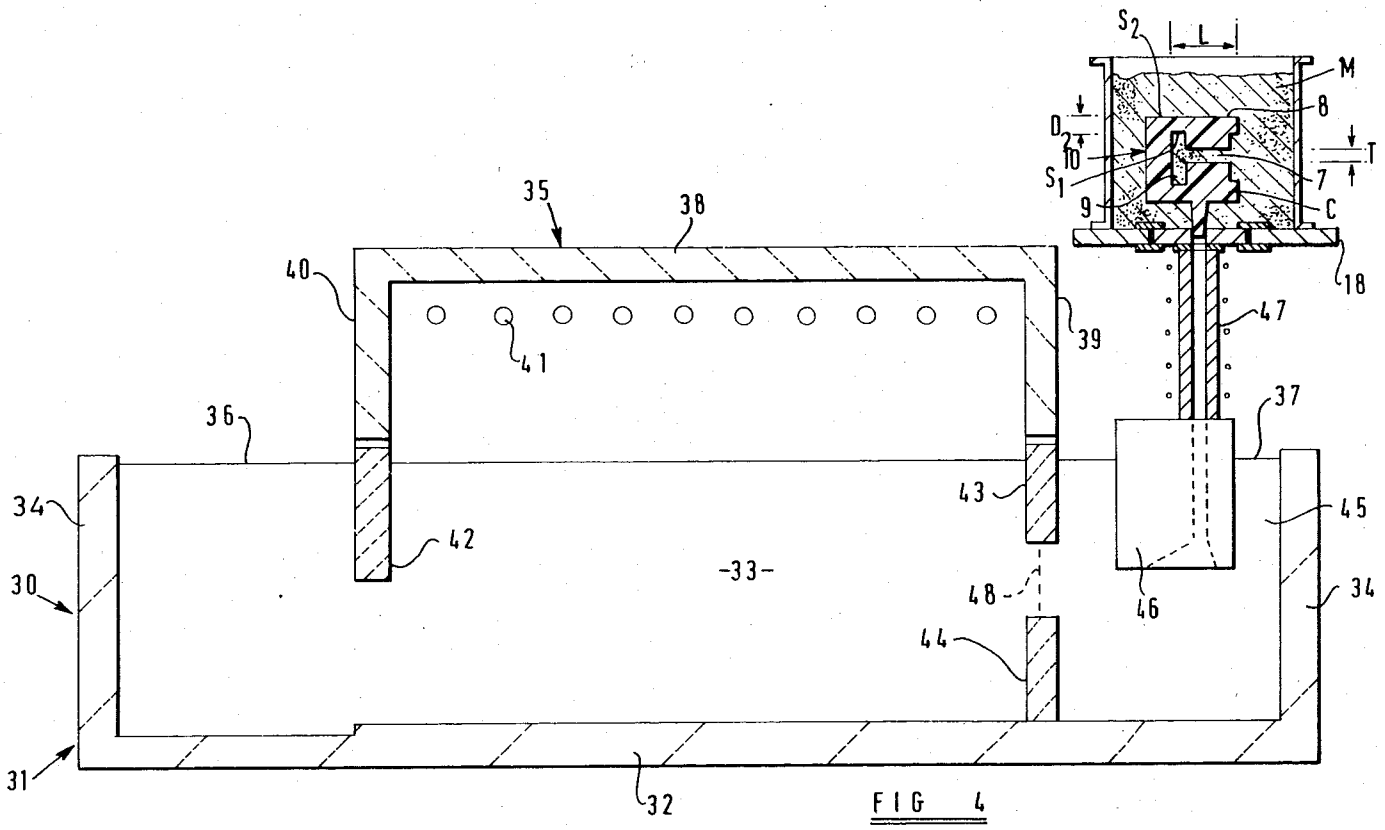
FIG. 4 is a diagrammatic cross-section, to a reduced scale, through a melter/holder furnace for use with the apparatus and pattern of FIGS. 1 and 2 in a second embodiment of the invention.

In this embodiment, referring particularly to FIG. 4, there is provided a melter/holder furnace 30 comprising a refractory lined vessel 31 having a generally rectangular base 32, and vertical side and end walls 33, 34 respectively. A roof 35 extends across the whole width of the vessel 31 but stops short of the end walls 34 to provide a charging well 36 and a pump well 37 at opposite ends of the vessel.

The roof 35 comprises a generally horizontal rectangular top part 38 and vertical side and end walls 39, 40 respectively. The roof 38 comprises suitable refractory material and within the roof are provided electrical radiant beaters 41.

The temperature of the heaters 41 and the number thereof and the area of the top part 38 of the roof are arranged so as to provide sufficient heat to melt ingots fed into the vessel 31 at the charging well 36 and to maintain the metal molten in the remainder of the vessel. A downwardly depending refractory wall 42 is provided at the charging well end of the vessel 31 to separate the charging well from the main heating part of the vessel whilst downwardly depending and upwardly extending refractory walls 43, 44 are provided at the pump well end of the vessel to define a casting vessel region 45 within which a pump 46 is provided. In the present example the pump 46 is an electro-magnetic pump which pumps metal from the region 45 through a riser tube 47 which is connected to the mould base 18 in exactly the same way as the riser tube 21 shown in FIG. 1. If desired a filter 48 may be provided between the walls 43 and 44 to filter metal entering the casting vessel 45.

The riser tube 47 and pump 46 provide a passage which has a lower end immersed in the molten metal in the furnace, an upper end for connection to the mould by sealing engagement with the insert 14, and an intermediate portion which extends through the free upper surface of the molten metal. If desired, other types of pump, separate from the furnace, may be used, such as a fluid pressure pump or the furnace may itself be pressurized analogously to the first embodiment to feed metal into the mould cavity.

In this embodiment the pattern has the configuration shown in FIG. 4 and the ration L:T is 5:1. In other respects the pattern is as described for the first embodiment and the same reference numerals are used fro the same parts.

In the examples described above the metal is fed upwardly into the mould cavity against the force of gravity which is the preferred method for the reasons explained hereinafter. If desired the mould cavity may be arranged to be filled by feeding metal downwardly under the form of gravity.

Figure 5:
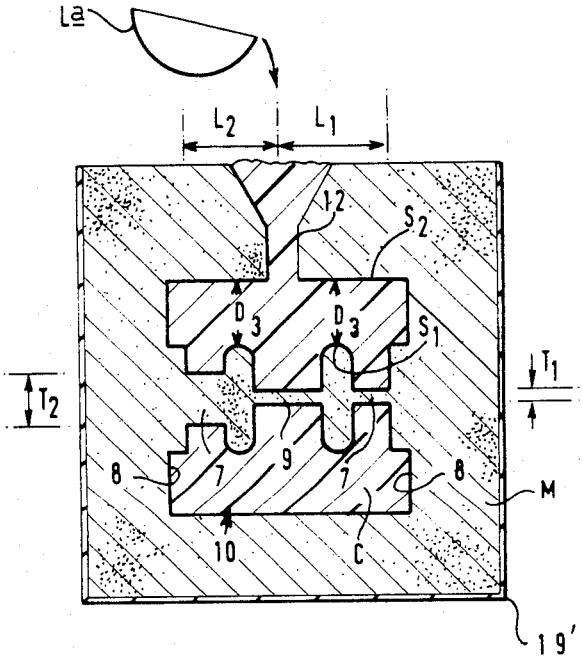
FIG. 5 is a diagrammatic cross-sectional view through an apparatus for performing a third embodiment of the invention.

In a third embodiment the metal and pattern are as described in connection with the first embodiment, except that a different shape of pattern is shown. In this embodiment the pattern has the configuration shown in FIG. 5. It will be seen that the moulding feature 9 bridges between the opposite sides of the main wall 8 of the cavity and comprises two sections, the lengths of which are indicated at L1 and L2, each section being connected to the associated side of the main wall 8 by a part 7 of the section, the minimum thickness of which is T1, T2 respectively. In this example the ratio L1:T1 is 9:1 whilst the ratio L2:T2 is 2.

In this embodiment the pattern 10 is embedded in 100% zircon sand as described hereinbefore in connection with the first embodiment and the sand is consolidated around the pattern again as described hereinbefore. In this case the casting ingate part 12 of the pattern is at the top of the pattern and the metal is poured into the mould from a ladle La downwardly through the casting ingate part 12. The sand is, of course, held within a container indicated at 19'. If desired the same shape of mould cavity may be provided in either of the first two described embodiments and vice versa.

In all the above described embodiments the moulding feature is of such a configuration that if the mould were made of 100% silica sand, apart from usual impurities, it would be found that a part of each moulding feature would be displaced by at least 5% from its designed position relative to the nearest part of the main wall of the cavity as shown at $D_1$, $D_2$ and $D_3$, whereas in the present invention such displacement does not occur as is demonstrated by the following Examples.

EXAMPLES

EXAMPLE 1

Figure 2:
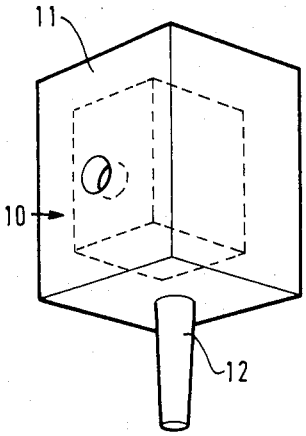
FIG. 2 is a perspective view of the pattern for the casting and ingate shown in FIG. 1.

The apparatus described with reference to FIGS. 1 to 3 was used to make 10 castings of the shape shown in FIGS. 1 and 2. 100% unbonded zircon sand by total weight of material was used as the sand 20 of which the mould was made.

The distance $D_1$ between the surface of the casting corresponding to the surface S1 of the moulding feature 9 and the surface of the casting corresponding to the top surface S2 of the pattern was measured for each casting and was found to differ by, an average, 2.4% from the desired distance.

EXAMPLE 2

The same measurements were performed as described in connection with Example 1 but using a mould made of 100% unbonded silica sand by total weight of material as the material 20 of the mould. In this case the above mentioned distance $D_1$ was found to differ, on average, by 15.2% from the desired distance.

EXAMPLE 3

The same measurements were performed as described in connection with the previous Examples but using 100% unbonded olivine sand by total weight of material as the material 20 of the mould. In this case the dimension $D_1$ was found to differ by, on average, 11% from the designed distance.

EXAMPLE 4

The castings in Examples 1–3 were examined for the surface finish achieved. The castings produced in Example 1 reproduced exactly the surface of the pattern and it was not possible to determine a lesser standard of finish due to the sand. In Examples 2 and 3 a distinct worsening of the surface finish due to metal penetration of the sand was observed on all castings.

It is to be noted that in all the above Examples the pattern used was unprovided with any refractory coating or wash nor was the pattern provided with any non-refractory wash to improve surface finish. The above set out results were attained with a completely uncoated pattern.

EXAMPLE 5

The following mechanical properties of the castings resulting from Examples 1–3 were determined, the average for each Example being as follows.

| Example | 0.2% P.S. M.P.A. | Elongation % | Brinwell Hardness HB |
|---|---|---|---|
| 1 | 270 | 3 | 110 |
| 2 | 220 | 1 | 85 |
| 3 | 230 | 1 | 90 |

It will be seen that significantly better mechanical properties were obtained with Example 1 than with the other Examples.

In all the above examples the metal cast was LM25 aluminum alloy and the examples were all made from this alloy and with the same heat treatment of the casting.

The aluminum alloy LM 25 has the following composition:

| Component | Chemical Composition Limits (Mass %) Remainder Al |
|---|---|
| Si | 6.5–7.5 |
| Fe | 0.5 |
| Cu | 0.1 |
| Mn | 0.3 |
| Mg | 0.2–0.45 |
| Zn | 0.1 |
| Ti | 0.2 |
| Ni | 0.1 |
| Pb | 0.1 |
| Sn | 0.05 |

Figure 6:
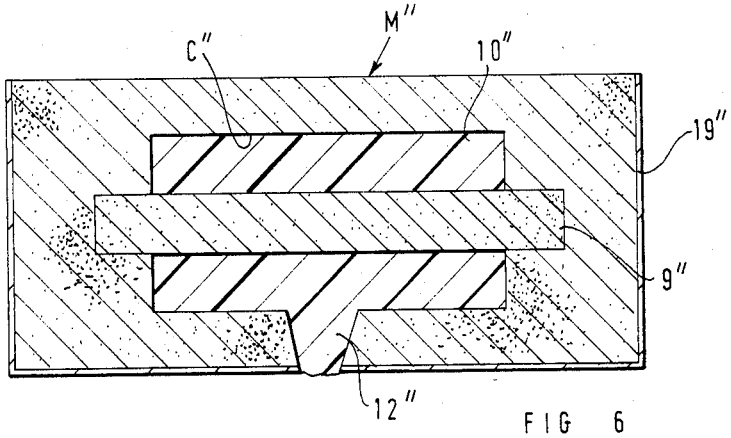
FIG. 6 is a diagrammatic cross-sectional view through a pattern for performing a fourth embodiment of the invention.

Referring now to FIG. 6, in which the same references are used to refer to corresponding parts as are used in FIGS. 1 to 5 but with the addition of a " sign.

In this embodiment the moulding feature comprises a core 9" which is preformed, in conventional manner, in zircon sand which comprises 100% of the sand of the core, except for usual impurities. If desired other sand, as hereinbefore defined, may be used and the zircon or other sand may comprise down to at least 50% of the sand. Alternatively, but less preferably, the core may comprise other sand such as silica or a mixture of sands. The zircon or other sand is preformed to make the core with the aid of a bonding agent or binder of conventional type.

The thus preformed core 9" is positioned within a pattern 10" of an in situ disposable material such as expanded polystyrene. This is done, in the present example, by expanding the polystyrene as described in connection with the previous embodiments in a die of a moulding machine in which the preformed core is located so that it is positioned in the pattern in the desired location.

The combined pattern 10" and preformed core 9" are then used to form a mould cavity C" in a mould M" which is made of 100% zircon sand except for usual impurities, (but which may be of any suitable particulate material when made in accordance with the second aspect of the invention) and the casting made as in the previously described embodiments. That is to say, the metal may be fed into the mould M" upwardly as described with reference to FIGS. 1 to 3 or FIG. 4, or downwardly as described with reference to FIG. 5 and details of the method and apparatus, except for the pattern, are as described previously.If desired more than one core or other moulding feature may be thus provided.

As the metal is cast the expanded polystyrene is replaced by the molten metal and the preformed sand core or cores define the internal configuration of the casting and are removed in conventional manner after the casting has solidified.

Although FIG. 6 shows the moulding feature as a core 9″ bridging across the mould cavity C″, the moulding feature may be of any desired shape or shapes and may be as hereindefined or of other shape or shapes falling outside the above definition and may be connected to the main wall of the cavity C″ at only one position.

The extent to which the moulding feature extends into the unbonded sand of the mould may differ from that described hereinbefore and indeed may not extend into the unbonded sand to any significant extent or at all.

The features disclosed in the foregoing description, or the accompanying drawings, expressed in their specific forms or in terms of a means of performing the disclosed function, or a method or process for attaining the disclosed result, may, separately or in any combination of such features, be utilised for realising the invention in diverse forms thereof.

I claim:

1. A method of making metal castings comprising the steps of providing an in situ destroyable pattern, then embedding the pattern in unbonded sand and consolidating the sand to form a mould in which is defined a mould cavity comprising at least one preformed moulding feature which is included in said pattern, then feeding a molten metal selected from the group consisting of aluminum and aluminum alloys into the cavity and permitting the metal to solidify within the cavity to form a casting and interrupting the feed of metal to the cavity and removing the casting from the cavity, wherein at least part of the mould is formed of sand which comprises at least substantially wholly sand selected from the group consisting of zircon sand and other particulate material suitable for making a mould having a bulk density lying in the range 2–3 gm/cc.

2. A method according to claim 1 wherein said preformed moulding feature has upper and lower surfaces for contact with the metal and projects inwardly of the mould cavity from a main wall thereof and has a configuration such that a mould made of 100% silica sand, except for usual impurities, and LM25 aluminum alloy is the metal cast, a part of the casting resulting from the moulding feature is displaced by at least 5% from its designed position relative to the nearest part of the casting defined by the main wall of the cavity.

3. A method according to claim 1 wherein the whole of the mould, except the or each preformed moulding feature, comprises unbonded said which comprises at least substantially wholly sand, selected from the group consisting of zircon sand and other particulate material suitable for making a mould having a bulk density lying in the range 2–3 gm/cc.

4. A method according to claim 1 wherein said part comprises at least one moulding feature which has upper and lower surfaces for contact with the metal and which projects inwardly of the mould cavity from a main wall thereof and has a configuration such that the length of any one section of the moulding feature is at least twice the thickness of the thinnest part thereof by which the section is connected to the main wall of the mould cavity.

5. A method of making metal castings comprising the steps of providing an in situ destroyable pattern, then embedding the pattern in unbonded sand and consolidating the sand to form a mould in which is defined a mould cavity, then feeding a molten metal selected from the group consisting of aluminum and aluminum alloys into the cavity and permitting the metal to solidify within the cavity to form a casting and interrupting the feed of metal to the cavity and removing the casting from the cavity, wherein the mould cavity comprises a moulding feature which has upper and lower surfaces for contact with the metal and which projects inwardly of the mould cavity from a main wall thereof and has a configuration such that a mould made of 100% silica sand, except for usual impurities, and LM25 aluminum alloy is the metal cast, a part of the casting resulting from the moulding feature is displaced by at least 5% from its designed position relative to the nearest part of the casting defined by the main wall of the cavity made of sand which comprises at least substantially wholly sand selected from the group consisting of zircon sand and other particulate material suitable for making a mould having a bulk density lying in the range 2–3 gm/cc.

6. A method according to claim 5 wherein the moulding feature is formed of unbonded sand.

7. A method according to claim 6 wherein the unbonded sand comprises at least substantially wholly zircon sand, except for usual impurities.

8. A method according to claim 5 wherein at least substantially the whole of the moulding feature is preformed of sand bonded with a bonding agent.

9. A method according to claim 8 wherein the bonded sand comprises at least substantially wholly zircon sand and bonding agent except for usual impurities.

10. A method according to claim 5 wherein the pattern is supported within a container, by means of a feed member which is mounted within the container, introducing the sand into the container to embed the pattern therein, and feeding metal into the mould cavity through a passage provided by the feed member into the mould cavity, an ingate part of the pattern being disposed in casting relationship with an orifice in the container and the metal being fed generally upwardly against the force of gravity to the orifice from a reservoir of molten metal which is at a level which is below the level of the cavity.

11. A method according to claim 5 wherein the moulding feature has upper and lower surfaces for contact with the metal and which projects inwardly of the mould cavity from a main wall thereof and has a configuration such that the length of any one section of the moulding feature is at least twice the thickness of the thinnest part thereof by which the section is connected to the main wall of the mould cavity.

12. A mould for making metal castings comprising consolidated unbonded sand in which is embedded an in situ destroyable pattern to define a mould cavity, there being provided in the mould cavity a moulding feature which has upper and lower surfaces for contact with the metal and which projects inwardly of the mould cavity from a main wall thereof and has a configuration such that a mould made of 100% silica sand, except for usual impurities, and LM25 aluminum alloy is the metal cast, a part of the casting resulting from the moulding feature is displaced by at least 5% from its designed position relative to the nearest part of the casting defined by the main wall of the cavity and comprising at least substantially wholly sand selected from the group consisting of zircon sand and other particulate material suitable for making a mould having a bulk density lying in the range 2–3 gm/cc.

13. A mould according to claim 12 wherein the moulding feature is formed of unbonded sand.

14. A mould according to claim 13 wherein the unbonded sand comprises at least substantially wholly zircon sand, except for usual impurities.

15. A mould according to claim 12 wherein at least substantially the whole of the moulding feature is preformed of sand bonded with a bonding agent.

16. A mould according to claim 15 wherein the bonded sand comprises at least substantially wholly zircon sand and bonding agent except for usual impurities.

17. A method of making metal castings comprising the steps of providing an in situ destroyable pattern, then embedding the pattern in unbonded sand and consolidating the sand to form a mould in which is defined a mould cavity, then feeding a molten metal selected from the group consisting of aluminum and aluminum alloys into the cavity and permitting the metal to solidify within the cavity to form a casting and interrupting the feed of metal to the cavity and removing the casting from the cavity, with at least part of the mould comprising at least one preformed moulding feature which is included in said pattern and being formed of sand which comprises at least substantially wholly sand selected from the group consisting of zircon sand and other particulate material suitable for making a mould having a bulk density lying in the range of 2–3 gm/cc.

* * * * *